United States Patent [19]

Noguchi et al.

[11] 4,047,507

[45] Sept. 13, 1977

[54] FUEL ECONOMIZING SYSTEM

[75] Inventors: Masaaki Noguchi, Nagoya; Masaharu Sumiyoshi, Toyoto; Nobuhito Hobo, Inuyama, all of Japan

[73] Assignees: Nippondenso Co., Ltd., Kariya; Toyota Jidosha Kogyo Kabushiki Kaisha, Toyota, both of Japan

[21] Appl. No.: 713,208

[22] Filed: Aug. 10, 1976

Related U.S. Application Data

[63] Continuation of Ser. No. 530,974, Dec. 9, 1974, abandoned.

[30] Foreign Application Priority Data

May 7, 1974 Japan ..... 49-50448

[51] Int. Cl.[2] ..... F02B 3/00; F02M 39/00

[52] U.S. Cl. ..... 123/32 Ea; 123/102; 123/139 AW; 123/32 EC; 123/32 EB

[58] Field of Search ..... 123/32 EA, 32 EE, 32 EB, 123/102; 180/105 E; 60/276, 285

[56] References Cited

U.S. PATENT DOCUMENTS

| | | | |
|---|---|---|---|
| 3,722,614 | 3/1973 | Sakakibari | 123/102 |
| 3,835,819 | 9/1974 | Anderson | 123/32 EB |
| 3,906,207 | 9/1975 | Rivere | 123/32 EA |

*Primary Examiner*—Carroll B. Dority, Jr.
*Assistant Examiner*—Ronald B. Cox
*Attorney, Agent, or Firm*—Cushman, Darby & Cushman

[57] ABSTRACT

There is provided a fuel economizing system comprising a constant speed control unit for varying the opening of a throttle valve to reduce the difference between the preset vehicle speed and the actual vehicle speed, fuel pattern setting means for setting the quantity of fuel required by an internal combustion engine, and fuel pattern correcting means for detecting the difference of the vehicle speeds and the variation of the quantity of fuel fed to the engine and correcting the fuel quantity set by the fuel pattern setting means, whereby the quantity of fuel fed to the engine is reduced while maintaining the constant speed driving function.

10 Claims, 9 Drawing Figures

FUEL ECONOMIZING SYSTEM

This is a continuation of application Ser. No. 530,974 filed Dec. 9, 1974, now abandoned.

The present invention relates to a fuel economizing system whereby under constant speed driving conditions of a vehicle equipped with a constant speed control unit, the quantity of fuel fed to an internal combustion engine is reduced while maintaining the constant speed driving function.

Generally, a vehicle which is equipped with a known constant speed control unit has the advantage that once the driver sets the constant speed control unit to the desired vehicle speed, the vehicle is maintained at the preset speed with the result that there is no need for the driver to change the depression of the accelerator pedal in response to variations in the load. Of particular advantage is the fact that the physical or mental fatigue of the driver is lessened during a long distance drive. In fact, however, the supply of fuel to the engine under constant speed driving conditions is effected in a manner similar to other driving conditions, so that the air-fuel ratio (A/F) of the mixture is selected in accordance with the fuel pattern preset to a point $P_o$ on the constant horsepower curve of FIG. 1 which uses the number of revolutions of the engine as the parameter, and this air-fuel ratio is economical and has an allowance for the acceleration performance. Therefore, the resulting fuel supply quantity ($Gf_o$) is greater than the minimum fuel supply quantity ($Gf_n$) which provides the required power for the constant speed driving. Consequently, since the acceleration performance is not essential under a constant speed driving condition of a vehicle, it is desirable that the fuel pattern for fuel supply is shifted from the point $P_o$ to a point $P_n$ in the characteristic diagram of FIG. 1 to operate the engine with the minimum fuel supply quantity ($Gf_n$).

On the other hand, with a known ignition distributor of the type which controls the ignition timing in accordance with the engine revolutions and the intake manifold pressure, the ignition timing is gradually retarded during the transition period from the fuel pattern represented by the point $P_o$ on the curve of FIG. 1 to the fuel pattern represented by the point $P_n$ so that the opening of the throttle valve is increased and the quantity of fuel delivered is decreased while maintaining the number of revolutions of the engine constant. However, experiments have proved that where the quantity of fuel delivered is to be decreased while maintaining the number of revolutions of the engine constant, it would be more effective to advance the ignition timing rather than retarding it.

Therefore, with a view to meeting these requirements, it is an object of the present invention to provide a fuel economizing system comprising a constant speed control unit for varying the opening of a throttle valve to reduce the error or difference between the preset vehicle speed and the actual vehicle speed, fuel setting means for detecting the operation condition of an internal combustion engine and feeding the required quantity of fuel to the engine, and fuel pattern correcting means for detecting the difference of the vehicle speed and the variation of the quantity of fuel fed to the engine and correcting the quantity of fuel fed to the engine only when the constant speed control unit is in operation, whereby the most economical quantity of fuel is fed to the engine in relation to the required engine output power for the constant speed driving of the vehicle for all the variations in the load.

The above and other objects, features and advantages of the present invention will become readily apparent from considering the following detailed description taken in conjunction with the accompanying drawings, in which.

The present invention will now be described in greater detail with reference to the accompanying drawings.

Figure 2:
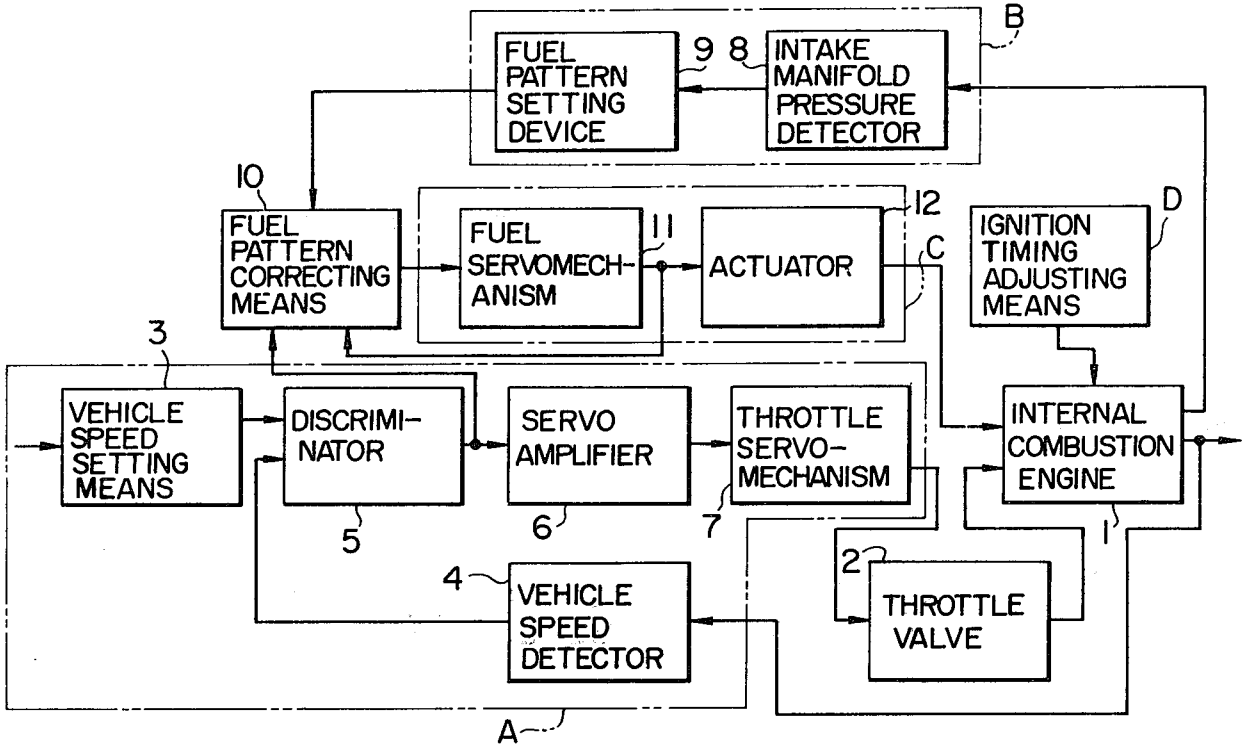
FIG. 2 is a block diagram showing the general construction of a fuel economizing system according to the present invention.

Referring first to FIG. 2 which illustrates the general construction of a fuel economizing system according to the invention. Numeral 1 designates an internal combustion engine, 2 a throttle valve. Numeral 3 designates vehicle speed setting means for presetting the vehicle speed to the desired value 4, a vehicle speed detector for detecting the actual vehicle speed, 5 a discriminator for comparing the preset vehicle speed and the actual vehicle speed to indicate the difference between the two vehicle speeds 6 a servo amplifier for amplifying the error or difference between the preset and actual vehicle speeds when the difference exceeds a predetermined value, 7 a throttle servomechanism which is operated by the servo amplifier 6 to vary the opening of the throttle valve 2. A known constant speed control unit A is constituted by the elements mentioned so far. Numeral 8 designates an intake manifold pressure detector for detecting the intake manifold pressure indicative of the operating condition of the engine 1, 9 a fuel pattern setting device which establishes the optimum fuel supply quantity in relation to the manifold pressure detected by the detector 8 and which constitutes fuel pattern setting means B along with the intake manifold pressure detector 8. Numeral 10 designates fuel pattern correcting means whereby when the constant speed control unit A is in operation, the difference between the preset and actual vehicle speeds and the variation of the quantity of fuel delivered are detected to correct the quantity of fuel delivered. Numeral 11 designates a fuel servomechanism for controlling the supply of fuel in accordance with the fuel pattern established by the fuel pattern setting device 9 and the fuel pattern correcting means 10, 12 an actuator for feeding the controlled quantity of fuel to the engine 1. The fuel servomechanism 11 and the actuator 12 constitute a fuel feeding means C. Symbol D designates ignition timing adjusting means for advancing the ignition timing by a predetermined amount when the constant speed control unit A is set into operation.

The general function of the system shown in FIG. 2 will now be described briefly. When a desired vehicle speed is established by the vehicle speed setting means 3 so that the constant speed control unit A comes into operation and the ignition timing is advanced by a predetermined amount, the vehicle speed detector 4 detects the actual vehicle speed, and the discriminator 5 compares the preset and actual vehicle speeds to indicate the difference therebetween. Then, the opening of the throttle valve 2 is adjusted by the servo amplifier 6 and the throttle servomechanism 7 in accordance with the deviation or difference between the preset and actual vehicle speeds. In other words, when the preset vehicle speed is greater than the actual vehicle speed, the opening of the throttle valve 2 is increased, whereas when the preset vehicle speed is lower than the actual vehicle speed, the opening of the throttle valve 2 is decreased. On the other hand, in the fuel pattern setting means B, the intake manifold pressure detector 8 detects the pressure in the intake manifold as one of the operating parameters of the engine 1, so that the fuel pattern setting device 9 establishes the quantity of fuel to be fed to the engine 1 in accordance with the detected manifold pressure. Further, in response to the initiation of the operation of the constant speed control unit A, the fuel pattern correcting means 10 detects the variation of the fuel quantity fed to the engine 1 by the fuel feeding means C comprising the fuel servomechanism 11 and the actuator 12 and the difference between the preset and actual vehicle speeds to correct the fuel quantity established by the fuel pattern setting means B and to thereby decrease the quantity of fuel fed to the engine 1 from the fuel feeding means C. At the same time, the constant speed control unit A operates to gradually open the throttle valve and thereby accomplish the preset constant speed driving. In this case, while the fuel pattern tends to shift toward a point Q through points $P_1, P_2, \ldots P_n$ on the constant horsepower characteristic curve of FIG. 1, the fuel pattern correcting means 10 detects that the fuel quantity is greater than the fuel quantity ($Gf_n$) corresponding to the point $P_n$ so that the fuel pattern is again shifted to the point $P_n$ which provides the minimum fuel quantity. In this way, the fuel pattern correcting means 10 shifts the fuel pattern to that pattern which supplies the most economical quantity of fuel to the engine 1, and thus the quantity of the fuel fed to the engine 1 is decreased.

Figure 3:
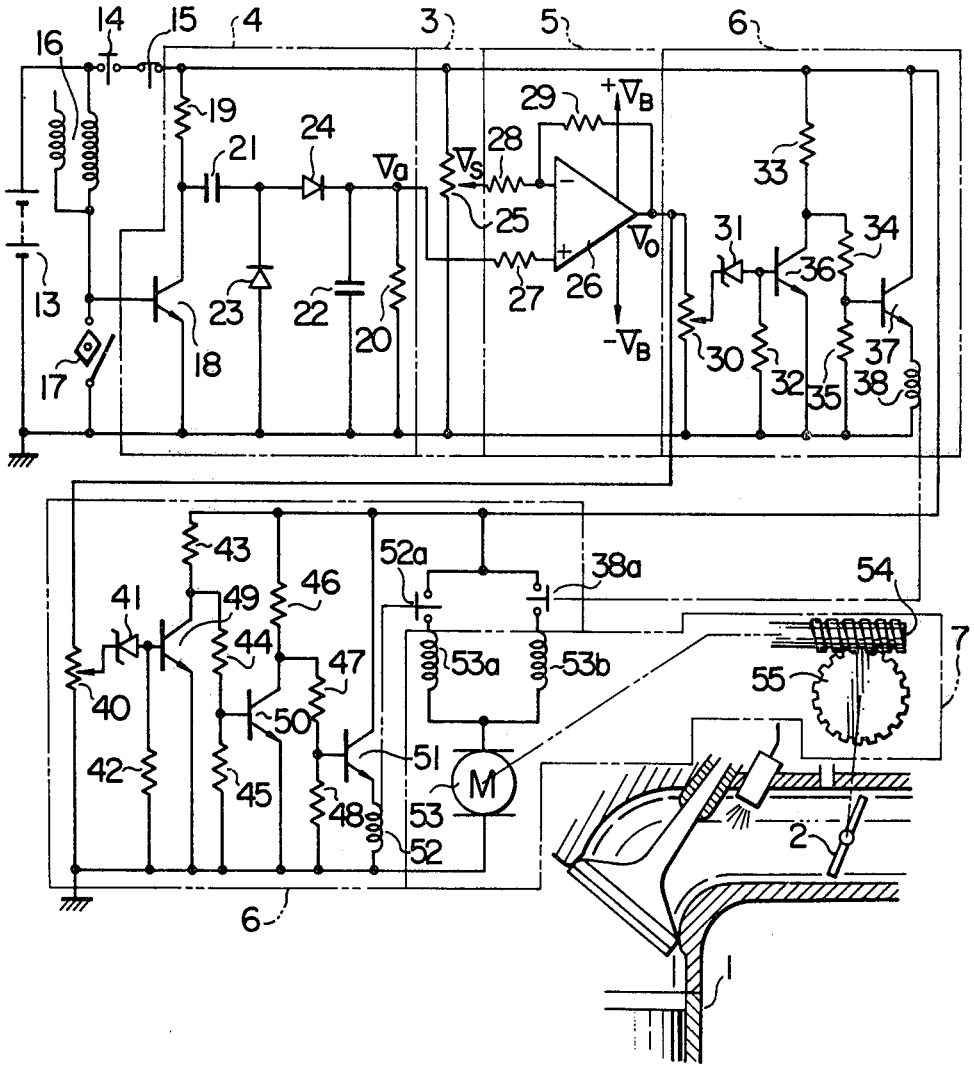
FIG. 3 is a wiring diagram showing an embodiment of the constant speed control unit used in the system of the invention shown in FIG. 2.

Next, the specific construction and operation of an embodiment of the individual elements used in the system of the invention shown in FIG. 2 will be described. Referring first to FIG. 3 illustrating the specific construction of the constant speed control unit A, numeral 13 designates a power source, 14 a normally open contact for setting the constant speed control unit A into constant speed operation, 15 a normally closed contact which is opened in response to the depression of for example a clutch pedal or brake pedal, 16 a high tension coil, 17 a contact breaker of the ignition distributor which opens and closes the contact points in synchronism with the rotation of the engine 1. The previously mentioned vehicle speed detector 4 comprises a transistor 18 having its base connected to a point between the high tension coil 16 and the contact breaker 17, resistors 19 and 20, capacitors 21 and 22, and diodes 23 and 24. The opening and closing of the contacts of the contact breaker 17 turns the transistor 18 on and off repeatedly, thus producing across the resistor 20 a voltage proportional to the number of revolutions of the engine 1, i.e., an output voltage $V_a$ is proportional to the actual vehicle speed. Numeral 25 designates a potentiometer constituting the previously mentioned vehicle speed setting means 3 for producing a voltage $V_s$ which is proportional to the preset vehicle speed. The discriminator 5 comprises an operational amplifier 26 and resistors 27, 28 and 29, and the output voltage $V_s$ of the vehicle speed setting means 3 and the output voltage $V_a$ of the vehicle speed detector 4 are respectively applied to the inverting input terminal (−) and the noninverting input terminal (+) of the operational amplifier 26. Thus, the discriminator 5 produces an output voltage $V_o$ which becomes $V_o = V_l (V_o > 0)$ when $V_a = V_s$, $V_o > V_l$ when $V_a > V_s$ and $V_o < V_l$ when $V_a < V_s$. The servo amplifier 6 comprises an amplifier composed of a potentiometer 30, a Zener diode 31, resistors 32, 33, 34 and 35, transistors 36 and 37 and a relay 38, and another amplifier composed of a potentiometer 40, a Zener diode 41, resistors 42, 43, 44, 45, 46, 47 and 48, transistors 49, 50 and 51 and a relay 52, whereby when the output voltage $V_o$ of the discriminator 5 is $V_o \geqq V_l + \delta$ (where $\delta > 0$), the transistors 49, 50 and 51 are respectively placed in the conditions of ON, OFF, and ON so that the relay 52 is energized to close its normally open contact 52*a,* while when $V_o \leqq V_l - \delta$ ($V_l - \delta > 0$), the transistors 36 and 37 are respectively placed in the conditions of OFF and ON so that the relay 38 is energized to close its normally open contact 38*a,* whereas when $V_l - \delta < V_o < V_l + \delta$, the relays 38 and 52 are not energized and the normally open contacts 38*a* and 52*a* remain open. In this case, the above-mentioned $\delta$ ($> 0$) is the predetermined voltage indicating that the difference between the preset and actual vehicle speeds is very small, and it is preset by the potentiometers 30 and 40 and the Zener diodes 31 and 41. The throttle servomechanism 7 comprises a servomoter 53, its field coils 53*a* and 53*b,* a worm 54 operatively associated with the servomoter 53 and a worm gear 55 which is in mesh with the worm 54 for rotating the throttle valve 2. Thus, when the field coil 53*b* is energized by the closing of the normally open contact 38*a,* the servomotor 53 is rotated in a direction which increases the opening of the throttle valve 2, whereas when the field coil 53*a* is energized in response to the closing of the normally open contact 52*a,* the servomotor 53 is rotated in a direction which decreases the opening of the throttle valve 2. Of course, the throttle valve 2 is linked in a usual manner to the accelerator pedal which is not shown. In this way, the constant speed control unit A responds to the difference between the desired preset vehicle speed and the actual vehicle speed to rotate the throttle valve 2 in a direction which eliminates the difference.

Figure 4:
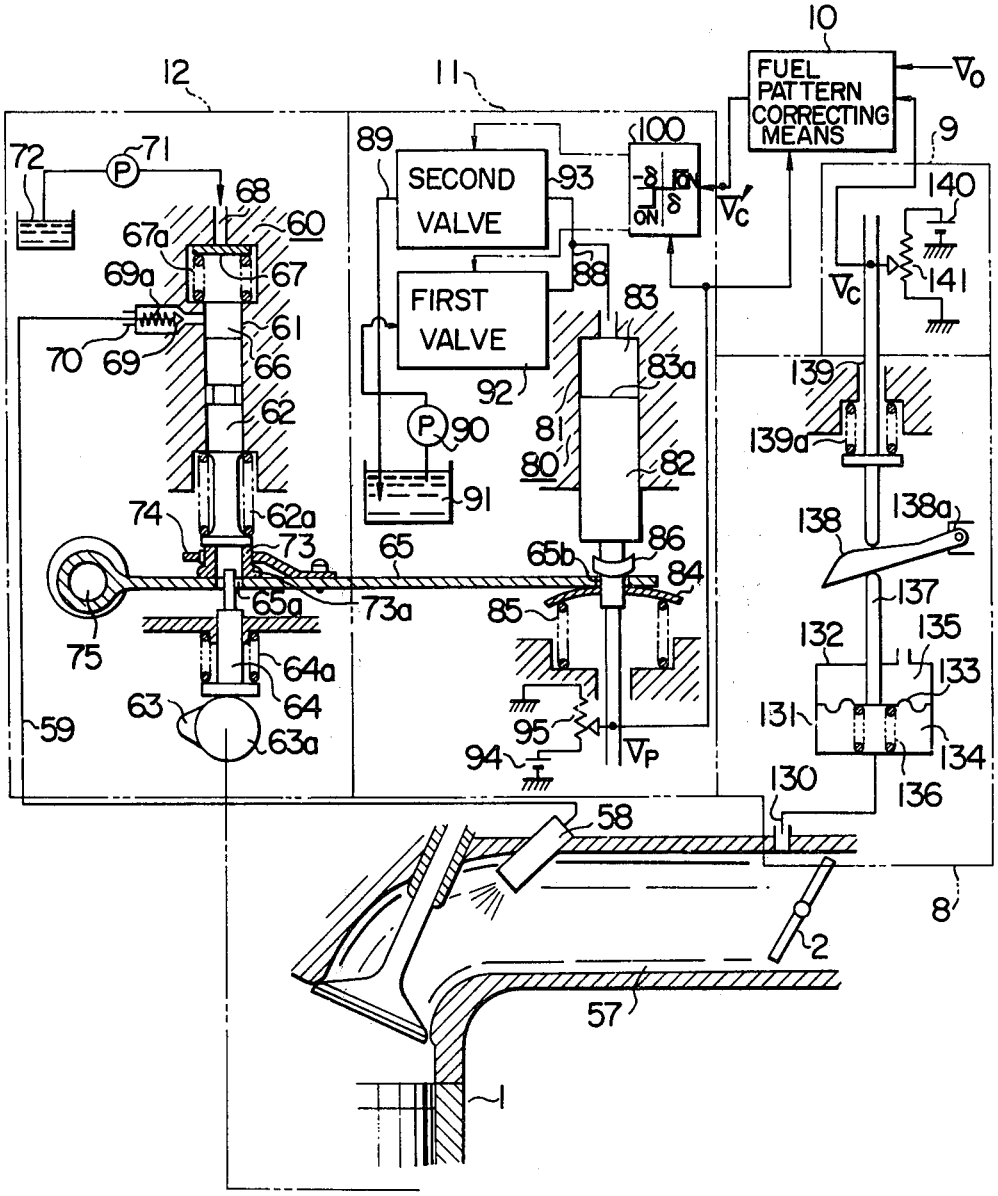
FIG. 4 is a schematic diagram showing the detailed construction of an embodiment of the fuel feeding means used in the system of the invention shown in FIG. 2.

Next, the respective specific constructions of the intake manifold pressure detector 8, the fuel pattern setting device 9, the fuel pattern correcting means 10, the fuel servomechanism 11 and the actuator 12 will be described with reference to FIGS. 4 through 6. Referring to FIG. 4, the actuator 12 comprises a fuel injection nozzle 58 mounted in an intake manifold 57 of the internal combustion engine 1, an injection pipe 59, a fuel injection pump 60 for supplying fuel under pressure to the injection pipe 59, a fuel feeding pump 71 and a fuel tank 72. The fuel injection pump 60 is designed to feed fuel under pressure to the fuel injection nozzle 58, and it comprises a plunger 62 adapted to reciprocate within a cylinder 61, a cam 63 which performs rotary motion, a tappet 64 is reciprocated by the rotation of the cam 63 to engage with the plunger 62 and thereby reciprocate the plunger 62, and a metering plate 65 which changes the axial position of the plunger 62 relative to the tappet 64 to change the position at which the plunger 62 engages the tappet 64 to control the stroke of the plunger 62. One end of the metering plate 65 is carried on an eccentric shaft 75. The plunger 62 defines a fluid chamber 66 within the cylinder 61 which communicates with an inlet passage 68 through an inlet valve 67 and an outlet passage 70 through an outlet valve 69. The inlet passage 68 is supplied with the fuel in the tank 72 by the operation of the fuel feed pump 71, while the outlet passage 70 supplies to the injection pipe 59 the fuel compressed in the chamber 66. Further, springs 67*a* and 69*a* respectively act on the inlet valve 67 and the outlet valve 69 to close them, and a spring 62*a* acts on the plunger 62 in a downward direction. The cam 63 has its cam shaft 63*a* connected by a suitable means such as a gear or a synchronizing belt to the crankshaft of the engine 1 which is not shown, so that if, for example, the engine 1 is a four-cycle engine, the cam 63 makes one complete rotation for every two revolutions of the crankshaft. The rear end face of the tappet 64 is pressed against the cam 63 by a spring 64*a*, and the front end face of the tappet 64 faces the rear end face of the plunger 62, so that when the tappet 64 has been raised a predetermined distance the action of the cam 63 thus bringing its front end face into contact with the rear end face of the plunger 62, the tappet 64 operates in unison with the plunger 62 to reciprocate the latter. A cylindrical member 73 having a flange 73*a* at its lower end is mounted on the metering plate 65 by a fixing plate 74 to allow some relative movement therebetween by virtue of the flange 73*a*. The rear end face of the plunger 62 faces the upper end face of the cylindrical member 73 so that when the plunger 62 has not been raised by the tappet 64, the rear end face of the plunger 62 is pressed against the upper end face of the cylindrical member 73 by the action of the spring 62*a*. The metering plate 65 is also provided with a hole 65*a* at its portion opposing the cylindrical member 73, and thus the tappet 64 is allowed to reciprocate through the hole 65*a* and within the cylindrical member 73.

With the construction described above, the actuator 12 operates as follows. When, in the fuel injection pump 60, the rotation of the cam 63 causes the tappet 64 to reciprocate and hence the plunger 62 reciprocates, the fuel in the fluid chamber 66 is compressed due to its volumetric change, and the outlet valve 69 is opened to feed the fuel forcibly through the injection pipe 59 to the fuel injection nozzle 58. This forced feeding of the fuel is effected in synchronism with the rotation of the crankshaft of the engine 1, and it is effected once for every two revolutions of the crankshaft (however, the fuel is fed once for every revolution of the crankshaft in the case of a two-cycle engine). The quantity of fuel fed during each forced feeding operation, i.e., the quantity of fuel injected through the fuel injection nozzle 58 may be varied by changing the position of the metering plate 65 to change the engaging position of the plunger 62 and the tappet 64 and thereby vary the stroke of the plunger 62. The metering plate 65 for varying the stroke of the plunger 62 is in turn controlled by the fuel servomechanism 11 which will be described hereunder.

The fuel servomechanism 11 comprises pressure control means 80 constituting a principal member and having a piston 82 linked to the end of the metering plate 65, a pressure fluid source 90 for controlling the position of the piston 82, a first valve 92, a second valve 93, and a control circuit 100 for controlling the opening and closing of the valves 92 and 93. In the pressure control means 80, the piston 82 is reciprocably fitted within a cylinder 81, and a fluid chamber 83 is defined in the cylinder 81 by the front end face of the piston 82. The front end face of the piston 82 also provides a movable wall 83*a* of the fluid chamber 83. With the piston 82 in this position, a spring 85 is disposed on the other side of the end of the metering plate 65 to exert an upward force through a spring retainer 84; and the metering plate 65 is provided at this portion with a hole 65*b* into which is fitted a piston retainer 86 having a pan-shaped, expanded upper portion, and the rear end face of the piston 82 is pressed against the upper end face of the piston retainer 86. The fluid chamber 83 communicates with two passages 88 and 89, of which the passage 88 is connected to a tank 91 containing fluid through feed pump 90 constituting the pressure fluid source, and the other passage 89 is connected directly to the low pressure relief side of the tank 91. While the forced fluid feed pump 90 is employed as the pressure fluid source, the lubricating oil in the engine 1 or the fuel supplied under pressure by the fuel feed pump may also be employed. The first valve 92 is provided in the passage 88 interconnecting the fluid chamber 83 and the pressure fluid source 90 and the second valve 93 is provided in the passage 89 interconnecting the fluid chamber 83 and the low pressure relief side of the tank 91, so that the opening of the first valve 92 causes the fluid under pressure to flow into the fluid chamber 83, whereas the opening of the second valve 93 causes the pressure fluid in the fluid chamber 83 to be exhausted back into the tank 91. Each of the first and second valves 92 and 93 consists of an electromagnetic valve, and the valves are controlled by the control circuit 100.

Figure 5:
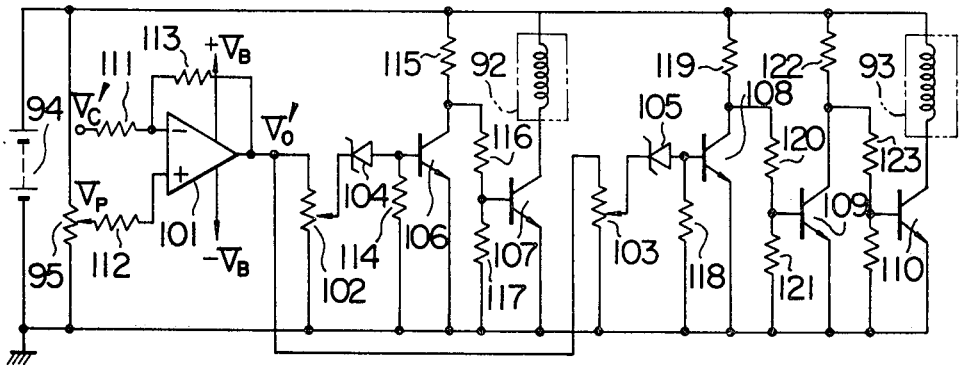
FIG. 5 is a wiring diagram of the control circuit used in the fuel feeding means shown in FIG. 4.

In FIG. 5 illustrating the circuit construction of the control circuit 100, numeral 94 designates a power source, 95 a potentiometer for generating a voltage $V_p$ whose value corresponds to the position of the metering plate 65, 101 an operational amplifier, 102 and 103 potentiometers, 104 and 105 Zener diodes, 106, 107, 108, 109 and 110 transistors, 111, 112, 113, 114, 115, 116, 117, 118, 119, 120, 121, 122, 123 and 124 resistors. The voltage $V_p$ generated by the potentiometer 95 is applied to the noninverting input terminal (+) of the operational amplifier 101 and an output voltage $V_c'$ of the fuel pattern correcting means 10 is applied to the inverting input terminal (−), so that when $V_p = V_c'$, then $V_o'$ ($V_l' > 0$). Further, the potentiometers 102 and 103 and the Zener diodes 104 and 105 are preadjusted so that when the output voltage $V_o'$ of the operational amplifier 101 becomes $V_o' \geqq V_l' + \delta'$ ($\delta' > 0$), the transistors 108, 109 and 110 are respectively placed in the ON condition, OFF condition and ON condition and the exciting coil of the second valve 93 is energized to open the second valve 93, whereas when $V_o' < V_l' - \delta'$, the transistors 106 and 107 are respectively placed in the OFF condition and ON condition and the exciting coil of the first valve 92 is energized to open it, while when $V_l' - \delta' < V_o' < V_l' + \delta'$, both the first and second valves 92 and 93 are closed. Here, the predetermined value $\delta'$ is a voltage which indicates that both the first and second valves 92 and 93 need not be opened.

With the fuel servomechanism 11 constructed as described above, when the output voltage $V_c'$ of the fuel pattern correcting means 10 is greater by a predetermined amount than the voltage $V_p$ representing the position of the metering plate 65 so that the control circuit 100 opens the first valve 92, the pressure fluid is introduced into the fluid chamber 83 from the pressure fluid source 90 and the piston 82 is moved downward in FIG. 4 against the spring 85. On the contrary, when the voltage $V_p$ is greater than the voltage $V_c'$ by a predetermined value, the control circuit 100 opens the second valve 93 and thus the fluid in the fluid chamber 83 is exhausted causing the spring 85 to move the piston 82 upward in FIG. 4. In response to the vertical movement of the piston 82, the metering plate 65 is rotated about the eccentric shaft 75 until both of the first and second valves 92 and 93 are closed. As mentioned earlier, the fuel servomechanism 11 controls the metering of the fuel delivered by the fuel injection pump 60 through the metering plate 65. The intake manifold pressure detector 8 comprises a pressure detecting port 130 provided in the intake manifold 57 downstream of the throttle valve 2, and a diaphragm mechanism 131 into which is introduced the intake manifold pressure taken off through the pressure detecting port 130 (here, the intake manifold pressure means a negative pressure lower than the atmospheric pressure, and an increase in the pressure means a reduction in the negative pressure). The diaphragm mechanism 131 is provided with two chambers 134 and 135 separated from each other by a diaphragm 133 in a housing 132 so that the intake manifold pressure is introduced into the chamber 134 and air is introduced into the other chamber 135. A spring 136 which opposes against the pressure difference between the chambers 134 and 135 acts on the diaphragm 133. A rod 137 is securely attached to the diaphragm 133 so that the rod 137 is movable in accordance with the deformation of the diaphragm 133, and the front end face of the rod 137 is pressed against one side of a cam member 138. Since the one side of the cam member 138 is formed into a single plane shape and the other side is formed to provide a cam face, the cam member 138 is rotatable about a fulcrum **138*a* in accordance with the movement of the rod 137. A rod 139 is pressed by the action of a spring 139*a* against the other side face of the cam member 138 constituting the cam face, so that in response to the rotation of the cam member 138 caused by the movement of the rod 137, the rod 139 is movable in non-linear relation with the movement of the rod 137 in accordance with the configuration of the cam face. In this case, since the quantity of fuel required by the engine 1 does not necessarily linearly correspond to the intake manifold pressure, the cam member 138 is shaped so that the movement of the rod 139 represents the quantity of fuel required by the engine 1. The fuel pattern setting device 9 comprises a power source 140 and a potentiometer 141 for generating the voltage $V_c$ which corresponds to the position of the rod 139 in the intake manifold pressure detector 8, whereby the optimum fuel quantity corresponding to the intake manifold pressure of the engine 1** is established, that is, the proper fuel pattern is established to generate the output voltage $V_c$.

Figure 6:
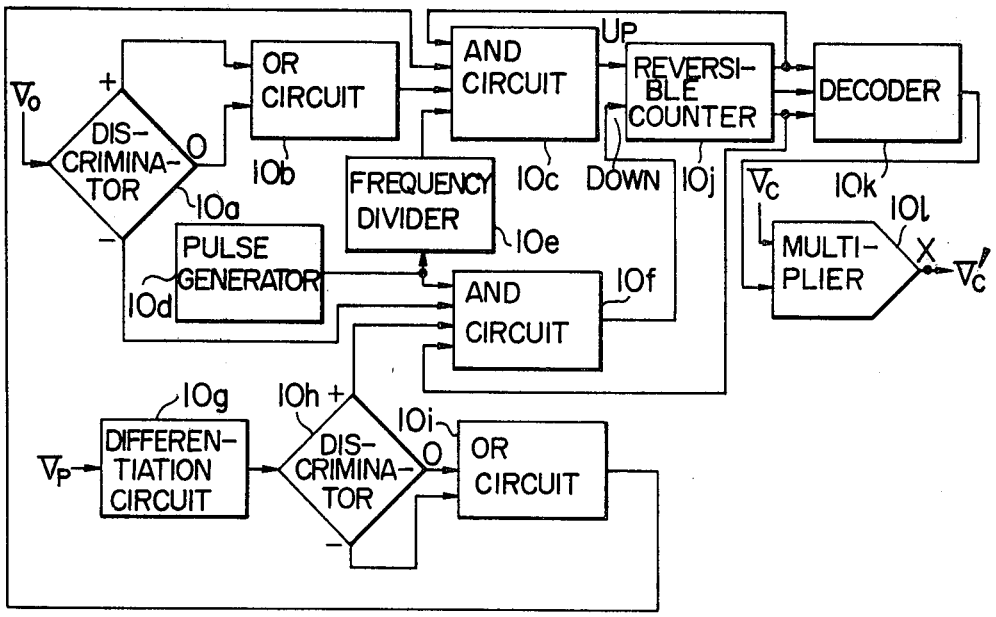
FIG. 6 is a block diagram of the fuel pattern correcting means used in the system of the invention shown in FIG. 2.

Referring now to FIG. 6, the fuel pattern correcting means 10 will be described. In FIG. 6, numeral **10*a* designates a discrminator for discriminating the difference between the preset vehicle speed and the actual vehicle speed (the difference corresponding to the voltage $V_o$), 10*b* an OR circuit constituting difference detecting means. Numeral 10*c* designates an AND circuit, 10*d* a pulse generator, 10*e* a frequency divider, 10*f* an AND circuit, 10*g* a differentiation circuit for detecting the variation of the fuel quantity (corresponding to the voltage $V_p$), 10*h* a discriminator for discriminating the differentiated value, 10*a* an OR circuit constituting fuel change detecting means. Numeral 10*j* designates a reversible counter for performing the operation of addition (up counting) and the operation of subtraction (down counting), 10*k* a decoder for generating an output signal which decreases from 1 by an amount corresponding to each increment from zero of the count of the reversible counter 10*j*, 10*l* a multiplier wherein the output voltage $V_c$ of the fuel pattern setting device 9 is multiplied by the output signal of the decoder 10*k* and whose output signal is the output voltage $V_c'$ of the fuel pattern correcting means 10. Briefly, the fuel pattern correcting means 10 operates as follows. When the difference between the preset and actual vehicle speeds (the remainder left when the preset vehicle speed is subtracted from the actual vehicle speed and corresponding to the voltage $V_o$) is positive or zero and when the rate of change ($dV_p/dt$) of the fuel injection quantity is negative or zero, the count of the reversible counter 10*j* increases to decrease the output voltage $V_c'$. However, when the count of the reversible counter 10*j* reaches its full extent, the output voltage $V_c'$ is decreased no further. On the other hand, when the difference between the vehicle speeds is negative and the rate of change of the fuel injection quantity is positive, the count of the reversible counter 10*j* decreases to increase the output voltage $V_c'$. In this case, when the count of the reversible counter 10*j* reaches zero, the output voltage $V_c'$ will not exceed the output voltage $V_c$ of the fuel pattern setting device 9**.

Figure 7:
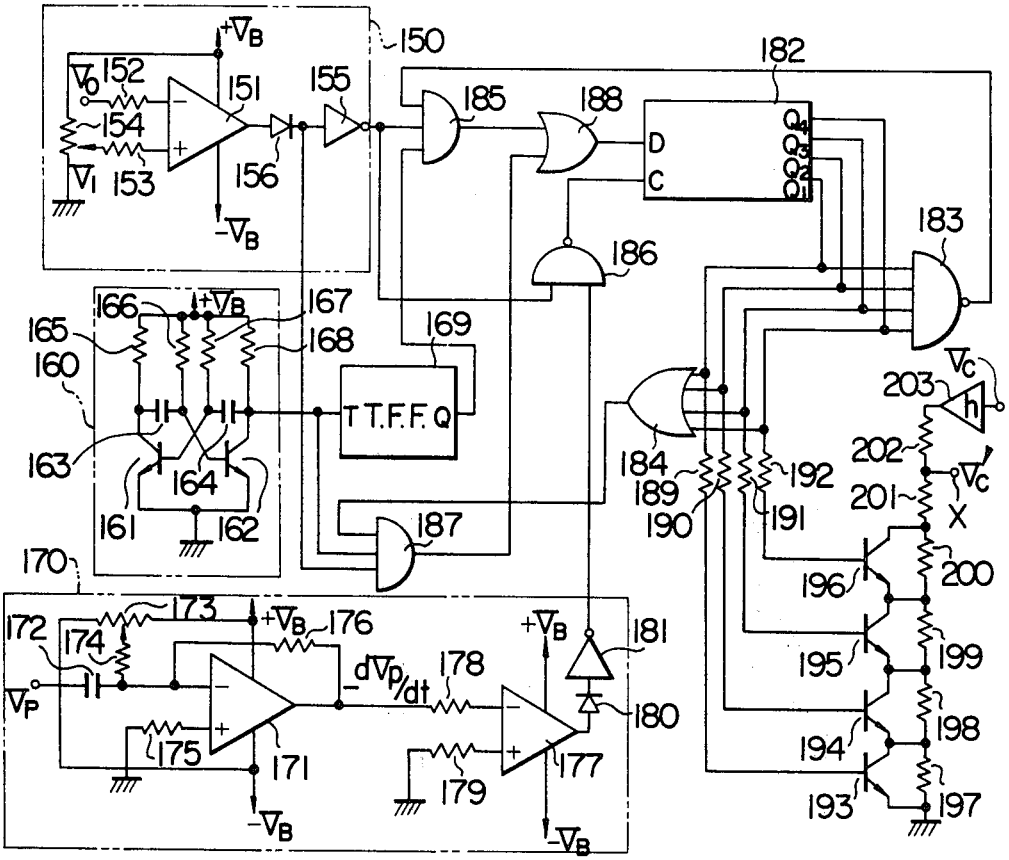
FIG. 7 is a wiring diagram showing an embodiment of the fuel pattern correcting means shown in FIG. 6.

Referring further to FIG. 7 illustrating a specific construction of the fuel pattern correcting means 10, numeral 150 designates difference detecting means comprising an operational amplifier 151, resistors 152 and 153, a potentiometer 154, an inverter 155 and a diode 156. The output voltage $V_o$ of the discriminator 5 in the constant speed control unit A and $V_1$ previously described in connection in FIG. 3, are respectively applied to the inverting input terminal (−) and the noninverting input terminal (+) of the operational amplifier 151, whereby a high level voltage (hereinafter simply referred to as a logical signal 1) or a low voltage (hereinafter simply referred to as 0) is generated at the output terminal of the inverter 155 in accordance with the difference between the preset vehicle speed and the actual vehicle speed. Numeral 160 designates a pulse generating circuit comprising transistors 161 and 162, capacitors 163 and 164 and resistors 165, 166, 167 and 168, and its output terminal is connected to the input terminal (T) of a T-type flip-flop 169 which in turn divides the frequency of the output pulses from the pulse generating circuit 160. A fuel change detecting means 170 comprises a differentiation circuit composed of an operational amplifier 171, a capacitor 172 and resistors 173, 174, 175 and 176, a sign inverting circuit composed of an operational amplifier 177 and resistors 178 and 179, a diode 180 and an inverter 181, and the voltage $V_p$ representing the position of the metering plate 65 shown in FIG. 4 is applied through the capacitor 172 to the inverting input terminal (−) of the operational amplifier 171 whose output voltage ($-dV_p/dt$) is in turn applied to the inverting input terminal (−) of the operational amplifier 177. Consequently, when the variation of the fuel quantity, time rate of change of the voltage $V_p$ ($dV_p/dt$), is negative or zero, then a 1 is generated at the output terminal of the inverter 181. Numeral 182 designates a reversible counter (such as the Texas Instruments SN74191) wherein the application of a 0 to the control terminal (designated at C) causes the counter to count in the usual manner (add up) the pulses applied to the input terminal (designated at D) and produce its output count 4-bit its 4-bit output terminals $Q_1$, $Q_2$, $Q_3$ and $Q_4$, whereas the application of 1 to the control terminal causes the counter to decrease (subtract) the count at the output terminals $Q_1$, $Q_2$, $Q_3$ and $Q_4$ each time a pulse is applied to the input terminal. Numerals 183 and 184 designate respectively a NAND gate and an OR gate which are respectively connected to the output terminals $Q_1$, $Q_2$, $Q_3$ and $Q_4$ of the reversible counter 182. Numeral 185 designates an AND gate having its input terminals respectively connected to the output terminals of the NAND gate 183, the inverter 155 of the difference detecting means 150 and the T-type flip-flop 169, 186 a NAND gate having its input terminals respectively connected to the output terminals of the inverter 181 in the fuel change detecting means 170 and the inverter 155 in the difference detecting means 150, 187 and AND gate having its input terminals respectively connected to the output terminals of the diode 156 in the difference detecting means 150, the pulse generating circuit 160 and the OR gate 184, 188 an OR gate having its input terminals respectively connected to the output terminals of the AND gates 185 and 187 and having its output terminal connected to the input terminal of the reversible counter 182. On the other hand, the output terminals $Q_1$, $Q_2$, $Q_3$ and $Q_4$ of the reversible counter 182 are respectively connected to the bases of transistors 193, 194, 195 and 196 through resistors 189, 190, 191 and 192, and connected respectively across the emitter and collector of the transistors 193, 194, 195 and 196 as shown in FIG. 7 are a series connected resistors 197, 198, 199 and 200 to which are further connected resistors 201 and 202 and an amplifier 203. The output voltage $V_c$ of the previously mentioned fuel pattern setting device 9 is applied to the input terminal of the amplifier 203. With the resistance values of the resistors 197, 198, 199, 200, 201 and 202 being respectively represented as $R_1$, $R_2$, $R_3$, $R_4$, $R_5$ and $R_6$, the amplification degree $h$ of the amplifier 203 is predetermined to be given as $$h = (R_1 + R_2 + R_3 + R_4 + R_5 + R_6)/(R_1 + R_2 + R_3 + R_4 + R_5)$$

Further, the fuel pattern correcting means 10 shown in FIGS. 6 and 7 is designed so that it comes into operation at the instant that the previously mentioned constant speed control unit A is set to the desired preset speed, and its output voltage $V_c'$ generated at the output terminal which is designated at a point X is applied to the previously mentioned control circuit 100 of the fuel servomechanism 11.

Next, the operation of this fuel pattern correcting means 10 will be described in connection with the operation of the system of the invention as a whole.

Firstly, when the constant speed control unit A is not set to any desired vehicle speed by the driver and the driver is driving the vehicle by depressing the accelerator pedal which is not shown, the fuel pattern correcting means 10 does not come into operation since it is designed to operate in association with the constant speed control unit A as mentioned hereinbefore. In this case, the intake manifold pressure of the engine 1 is detected by the intake manifold pressure detector 8 and the fuel pattern setting device 9 generates its output voltage $V_c$ which establishes the optimum fuel injection quantity corresponding to the intake manifold pressure. At this time, the transistors 193, 194, 195 and 196 of the fuel pattern correcting means 10 shown in FIG. 7 are all in the off condition, and therefore the output voltage $V_c'$ of the fuel pattern correcting means 10 is given by the following equation:

$$V_c' = \frac{R_1 + R_2 + R_3 + R_4 + R_5}{R_1 + R_2 + R_3 + R_4 + R_5 + R_6} \cdot h \cdot V_c$$

$$= \frac{R_1 + R_2 + R_3 + R_4 + R_5}{R_1 + R_2 + R_3 + R_4 + R_5 + R_6} \cdot \frac{R_1 + R_2 + R_3 + R_4 + R_5 + R_6}{R_1 + R_2 + R_3 + R_4 + R_5} \cdot V_c$$

$$= V_c$$

In other words, the output voltage $V_c$ of the fuel pattern setting device 9 directly appears as such as the output voltage $V_c'$ ($V_c' = V_c$) of the fuel pattern correcting means 10. In the fuel servomechanism 11, the control circuit 100 opens and closes the first and second valves 92 and 93 to move the piston 82 and thereby change the position of the metering plate 65 to correspond to the output voltage $V_c'$ ($V_c' = V_c$), and in this way the metering plate 65 is rotated and displaced into the position corresponding to the output voltage $V_c$ of the fuel pattern setting device 9, that is, the position corresponding to the intake manifold pressure of the engine 1. The plunger 62 of the injection pump 60 whose stroke or fuel injection quantity is controlled by the metering plate 65 reciprocates in synchronism with the rotation of the engine 1 and injects the fuel into the intake manifold 57 through the fuel injection nozzle 58. In this case, it is evident that the output voltage $V_c$ of the fuel pattern setting device 9 increases as the intake manifold pressure of the engine 1 increases and the position of the metering plate 65 is correspondingly displaced downward in FIG. 4, thus causing the actuator 12 to inject an increased amount of fuel.

Figure 1:
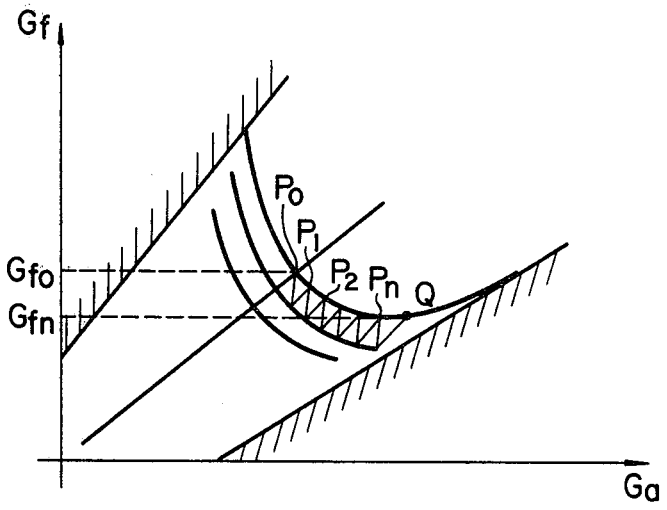
FIG. 1 is a constant horsepower characteristic diagram utilizing the number of revolutions of an internal combustion engine as a parameter.

On the other hand, if the driver sets the constant speed control unit A to the then current vehicle speed when the engine 1 is operating in accordance with the fuel pattern represented by the point $P_o$ on the constant horsepower characteristic curve of FIG. 1 which utilizes the engine rpms as the parameter, the ignition timing is advanced by a predetermined angle as mentioned hereinbefore. In the fuel pattern correcting means 10 shown in FIG. 7, a 1 is generated at the output terminal of the inverter 155 in the difference detecting means 150 so that there is no change in the quantity of fuel injected by the actuator 12, and a 1 is generated at the output terminal of the inverter 181 of the fuel change detecting means 170, thus generating an 0 at the output terminal of the NAND gate 186. When a 1 represented by the pulses produced by dividing the output pulses of the pulse generating circuit 160 through the T-type flip-flop 169 and a 1 generated from the NAND gate 183 are applied to the AND gate 185, a 1 is applied to the input terminal of the reversible counter 182 through the OR gate 188. If this is represented by the count generated at the output terminals $Q_1$, $Q_2$, $Q_3$ and $Q_4$ of the reversible counter 182, that is, the values at the output terminals $Q_4$, $Q_3$, $Q_2$ and $Q_1$, the application of the 1 to the reversible counter 182 changes its count from 0, 0, 0, 0, to 0, 0, 0, 1. When the 1 is generated at the output terminal $Q_1$ of the reversible counter 182, the transistor 193 is turned on, and the output voltage $V_c'$ of the fuel pattern correcting means 10 assumes the voltage value given by the following equation:

$$V_c' = \frac{R_2 + R_3 + R_4 + R_5}{R_2 + R_3 + R_4 + R_5 + R_6} \cdot h \cdot V_c$$

This output voltage $V_c'$ is lower than the above-mentioned output voltage $V_c'$ ($V_c' = V_c$) generated when the constant speed control unit A was not operated. Consequently, the control circuit 100 in the fuel servomechanism 11 opens the second valve 93 to exhaust the pressure fluid in the fluid chamber 83 back into the tank 91, so that the metering plate 65 is rotated and displaced upward in FIG. 4, and the quantity of fuel injected by the actuator 12 is decreased. In this operation, the fuel change ($dV_p/dt$) never assumes a positive value (there is a 1 at the output terminal of the inverter 181 in the fuel change detecting means 170), and consequently the application of successive 1's to the input terminal of the reversible counter 182 in the fuel pattern correcting means 10 changes its count from 0, 0, 0, 1 to 0, 0, 1, 0; . . . , until the difference (corresponding to the voltage $V_o$ of FIG. 3) between the preset vehicle speed (corresponding to the voltage $V_S$ of FIG. 3) and the actual vehicle speed (corresponding to the voltage $V_a$ of FIG. 3) exceeds a predetermined value. In accordance with such increase in the count, the output voltage $V_c'$ of the fuel pattern correcting means 10 is decreased and hence the quantity of fuel injected is also decreased. Thereafter, when the actual speed and the preset speed of the vehicle deviate with respect to each other due to the decreased fuel injection quantity so that the output voltages $V_o$ of the discriminator 5 of the constant speed control unit A shown in FIG. 3 becomes lower than the value of $V_I - \delta$, the opening of the throttle valve 2 is increased by the servo amplifier 6 and the throttle servomechanism 7. In this case, an 0 is generated at the output terminal of the inverter 155 in the difference detecting means 150 and a 1 is applied to the control terminal of the reversible counter 182 through the NAND gate 186. Consequently, unless the count of the reversible counter 182 is 0, 0, 0, 0, the 1 generated at the output terminal of the AND gate 187 is applied to the input terminal of the reversible counter 182 through the OR gate 188. When this occurs the application of successive 1's to the reversible counter 182 changes its count from, for example, 0, 1, 0, 1 to 0, 1, 0, 0; 0, 0, 1, 1 and so on. As a result, each time the count of the reversible counter 182 is decreased, the output voltage $V_c'$ of the fuel pattern correcting means 10 is increased, so that the metering plate 65 of the fuel servomechanism 11 is rotated and displaced downward in FIG. 4 and the quantity of fuel injected by the actuator 12 is also increased. Further, since the pulses applied to the AND gate 187 from the pulse generating circuit 160 are not subjected to frequency division, the time rate of change of the decrease in the count of the reversible counter 182 is faster than was the case with the previously mentioned increase in the count, and therefore the increase in the quantity of fuel delivered to the engine 1 also takes place faster. By increasing the opening of the throttle valve 2 and increasing the fuel injection quantity in this way, the actual vehicle speed rapidly approaches the preset vehicle speed and eventually the difference between the vehicle speeds is reduced to zero. In other words, the fuel pattern established by the fuel pattern setting device 9 and represented by the point $P_o$ on the curve of FIG. 1 is shifted to the fuel pattern represented by the point $P_1$ on the same curve by the fuel pattern correcting means 10. In the like manner, the fuel pattern correcting means 10 successively shifts the fuel pattern to the fuel patterns represented by points $P_2$, $P_3$, . . . , $P_n$. Thus, the fuel pattern is finally shifted to the one which is represented by the point $P_n$ and which ensures the most economical value ($Gf_n$) of the fuel injection quantity in relation to the output power of the engines 1 which is required for the constant speed driving of the vehicle. Further, while it is of course possible that the fuel pattern correcting means 10 shifts the fuel pattern in such a manner as to increase the fuel injection quantity in response to variation of the load on the engine 1 during the fuel pattern shifting period, as soon as the variation of the engine load terminates, the fuel pattern is shifted in the same manner as previously described to the one represented by the point $P_n$, and thus the engine 1 is operated with the most economical fuel injection quantity ($Gf_n$). Here, while the percentage of the decrease in the fuel injection quantity may be predetermined as desired by suitably selecting the resistance values $R_1$, $R_2$, $R_3$, $R_4$, $R_5$ and $R_6$ of the fuel pattern correcting means 10, it should preferably be in the range between 3 and 5%. Further, while, during the transition period of the fuel pattern from the point $P_o$ to the point $P_n$ on the curve of FIG. 1, it is preferable that the ignition timing of the engine 1 always corresponds to the one which provides the maximum torque, the ignition timing may be preliminarily advanced by a predetermined angle at the instant that the constant speed control unit A is set to the desired speed, so that when the fuel pattern is finally shifted to the one approximately represented by the point $P_n$ on the curve of FIG. 1, the ignition timing at this time is very close to the one which ensures the maximum torque of the engine 1 and the fuel injection quantity (Gf) also approaches the most economical value ($Gf_n$), thus effectively reducing the quantity of fuel delivered during the constant speed driving period.

Figure 8:
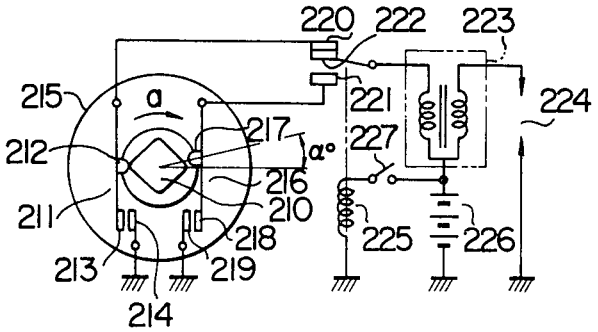
FIG. 8 is a wiring diagram showing an embodiment of the ignition timing adjusting means used in the system of the invention shown in FIG. 2.

This adjustment of the ignition timing is accomplished by the ignition timing adjusting means D shown in FIG. 2. While, in the illustrated embodiment of this invention, the ignition timing is advanced by a predetermined angle simultaneously with the setting of the constant speed control unit A to the desired speed so that the ignition timing is compensated to approximate the ignition timing which ensures the maximum torque of the engine 1 in relation to the air-fuel ratio (A/F) of the mixture during the fuel pattern shifting period, an exemplary construction of the ignition timing adjusting means D designed for this purpose will now be described with reference to FIG. 8. In FIG. 8, numeral 210 designates a contact breaker cam which rotates once for every two revolutions of the engine crankshaft, 211 a first contact breaker comprising a lifter 212 and a contact 213 which are integral with each other. The first breaker 211 constitutes part of a known type of distributor wherein when the breaker cam 210 is in engagement with the lifter 212, the contact 213 is separated from a stationary contact 214. In addition to the first contact breaker 211, a second contact breaker 216 is provided on a movable base 215 so that the engagement of the breaker cam 210 with a lifter 217 causes a contact 218 to separate from a stationary contact 219 in advance of the separation of the contact 213 from the stationary contact 214 by an angle of $\alpha°$. Numerals 220 and 221 designate stationary contacts respectively connected electrically to the first and second contact breakers 211 and 216, 222 a movable contact, 223 an ignition coil, 224 a spark plug, 225 a relay coil, 226 a power source, 227 a switch operatively associated with the normally open contact 14 shown in FIG. 3 and adapted for setting the constant speed control unit A into operation. When the switch 227 is in the open position, the movable contact 222 and the stationary contact 220 are closed, whereas when the switch 227 is closed, the relay coil 225 is energized to close the movable contact 222 and the stationary contact 221. Of course, the angle $\alpha°$ must be selected so that the ignition timing obtained ensures the maximum torque of the engine in relation to the air-fuel ratio (A/F) of the mixture in the vicinity of the point $P_n$ in the region $P_o - P_n$ on the constant horsepower characteristic curve shown in FIG. 1. Consequently, unless the constant speed control unit A is in operation, the ignition timing of the spark plug 224 is determined through the first contact breaker 211, whereas when the constant speed control unit A is in operation, the ignition timing is determined through the second contact breaker 216. In this way, when the constant speed control unit A is set into operation, the ignition timing is advanced by the angle of $\alpha°$ and the quantity of fuel delivered is effectively reduced while the constant speed control unit A is in operation.

It should be noted that the intended objective of the present invention, i.e., the desired fuel economy can be achieved satisfactorily only by shifting the fuel pattern through the fuel pattern correcting means 10 without the provision of the above-described ignition timing adjusting means D.

Figure 9:
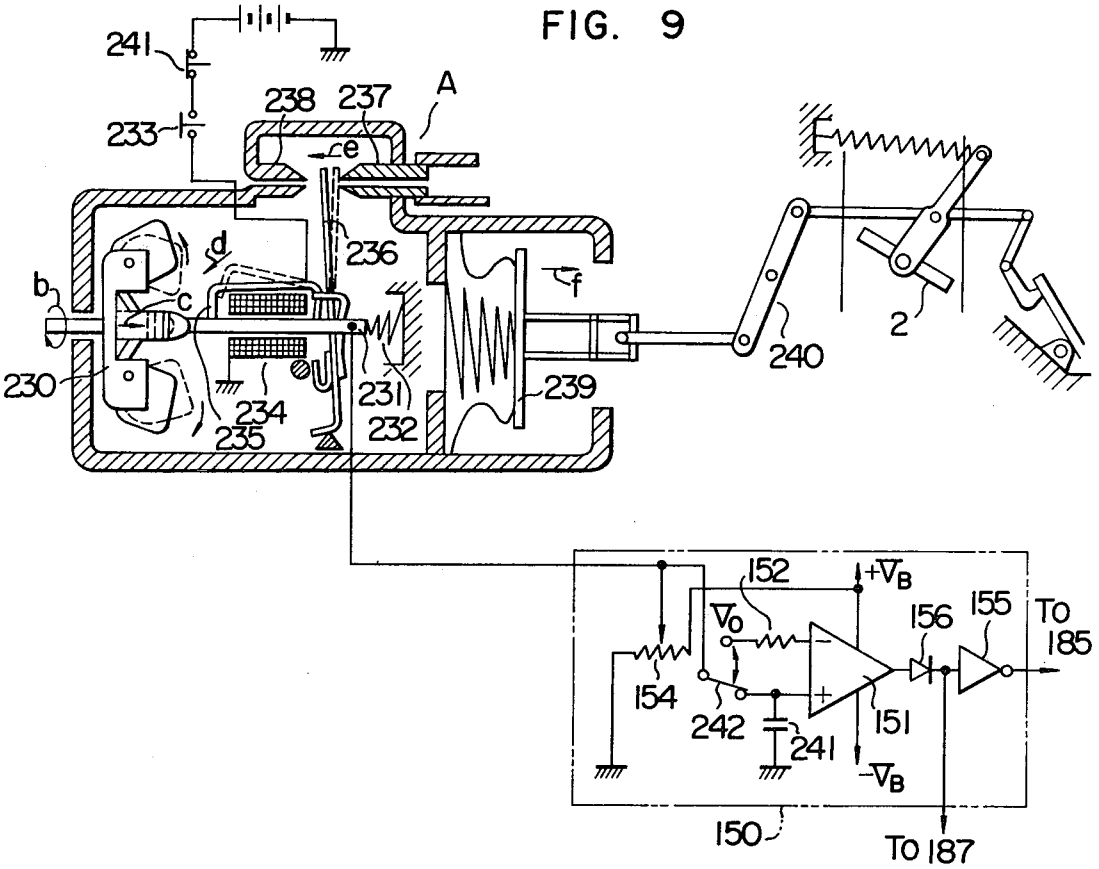
FIG. 9 is a schematic diagram showing another embodiment of the constant speed control unit used in the system of the invention shown in FIG. 2.

While an exemplary embodiment of the present invention has been described hereinabove, the constant speed control unit A may be of a type which is controlled mechanically. The operation of such a mechanically controlled constant speed control unit will be described with reference to a known arrangement shown in FIG. 9. In this arrangement, in accordance with the number of revolutions of the engine, a centrifugal governor 230 is rotated in the direction of an arrow *b,* and a control core 231 is displaced in the direction of an arrow *c* until it is balanced with a reaction spring 232. Namely, the position of the control core 231 indicates the actual vehicle speed. When a normally open contact 233 is closed upon reaching the desired vehicle speed, a locking coil 234 is energized to attract an armature 235 in the direction of an arrow *d* and a flapper valve 236 is rotated in the direction of an arrow *e* to join the control core 231 and the flapper valve 236 together and establish the preset vehicle speed. Thereafter, when the actual vehicle speed exceeds the preset vehicle speed, the flapper valve 236 closes a vacuum nozzle 237 connected to the engine manifold which is not shown, so that air is introduced through an air nozzle 238 leading to the atmosphere to move a diaphragm 239 in the direction of an arrow *f,* and the opening of the throttle valve 2 is decreased through a link mechanism 240. On the contrary, when the actual vehicle speed drops below the preset vehicle speed, the flapper valve 236 closes the air nozzle 238 to introduce the manifold pressure (negative pressure) and thus the diaphragm 239 is moved in a direction opposite to the direction of the arrow *f* to increase the opening of the throttle valve 2. The purpose of a normally closed contact 241 is to release the constant speed control unit A. In this way, the mechanically controlled constant speed control unit A can accomplish the equivalent function as the electrically controlled constant speed control unit A described in detail in connection with FIG. 3. In the event that the mechanically controlled constant speed control unit A is employed, the difference detecting means 150 described with reference to FIG. 7 may be constructed as shown in the lower portion of FIG. 9 which is enclosed with dotted lines so that the difference between the actual vehicle speed and the preset vehicle speed is discriminated by the fuel pattern correcting means 10 shown in FIGS. 2 and 6. In other words, to establish the preset vehicle speed, a capacitor 241 connected to the noninverting input terminal (+) of the operational amplifier 151 is charged in accordance with the position of the displaced control core 231 to memorize the preset vehicle speed, and a switch 242 operatively associated with the normally open contact 233 is thrown to the inverting input terminal (−) side of the operational amplifier 151, thereby causing the output voltage $V_o$ of the potentiometer 154 to vary in accordance with the displacement of the control core 231 after the establishment of the preset vehicle speed.

Further, while, in the arrangement shown in FIGS. 2 and 4, the intake manifold pressure is detected as a means of detecting the quantity of fuel required by the engine, the temperature and the number of revolutions of the engine may be detected to provide additional fuel injection quantity correcting means which decreases the fuel injection quantity in relation to the rise in the temperature and revolutions of the engine. Furthermore, while the actuator 12 principally comprised of the fuel servomechanism 11 and the fuel injection pump 60 is employed as the means of metering and injecting the proper quantity of fuel to meet the requirements of the engine, electronically controlled means may be utilized in which electromagnetically operated fuel injection nozzles are employed and the pulse width of pulse signals applied to the nozzles is controlled to accomplish the required metering and injection of fuel.

It will thus be seen from the foregoing description that since the fuel economizing system according to the present invention comprises a constant speed control unit for varying the opening of a throttle valve to reduce the difference between the preset and actual vehicle speeds, fuel feeding means for detecting the operating condition of an internal combustion engine and feeding the required quantity of fuel to the engine, and fuel pattern correcting means for detecting the variation of the difference between the vehicle speeds and the quantity of fuel fed to the engine and correcting the quantity of fuel fed to the engine only when the constant speed control unit is in operation and thus the acceleration performance of the engine is not particularly required, the system of this invention has a very great advantage that the constant speed driving of the vehicle can be accomplished, with the quantity of fuel fed to provide the required power of the engine for the constant speed driving being maintained at the most economical value.

What is claimed is:

1. A fuel economizing system comprising:

constant speed control means for detecting the difference between the preset speed of a vehicle and the actual speed of said vehicle and for varying the opening of a throttle valve to reduce said difference to zero;

fuel pattern setting means for detecing the operating condition of an internal combustion engine and for setting the quantity of fuel to be required by said engine;

fuel pattern correcting means connected to said constant speed control means when said constant speed control means is in operation and to said fuel pattern setting means, said fuel pattern correcting means being adapted to correct said quantity of fuel to reduce it when said actual speed is not less than said preset speed and the variation of the quantity of fuel is not increasing; and fuel feeding means connected to said fuel pattern correcting means for feeding to said engine the quantity of fuel corrected by said fuel pattern correcting means, wherein the output of said fuel pattern setting means is connected directly to said fuel feeding means when said constant speed control means is not in operation.

2. The fuel economizing system of claim 1 further comprising ignition timing adjusting means for advancing the ignition timing of said engine by a predetermined amount when said constant speed control means is set into operation.

3. A fuel economizing system comprising:

constant speed control means for controlling the opening condition of a throttle valve in response to the difference between a preset speed and an actual speed;

fuel pattern setting means for detecting an operational condition of an internal combustion engine and for setting the quantity of fuel to be required by said engine in accordance with a predetermined fuel pattern;

fuel pattern correcting means connected to said constant speed control means when said constant speed control means is in operation, and to said fuel pattern setting means, said fuel pattern correcting means being adapted to reduce said quantity of fuel set by said fuel pattern setting means when said actual speed is not less than said preset speed and the variation of said quantity of fuel is not increasing, said fuel pattern correcting means being adapted to operate only when said constant speed control means is in operation; and fuel feeding means connected to said fuel pattern correcting means for feeding to said engine the quantity of fuel corrected by said fuel pattern correcting means, said fuel feeding means feeding the fuel set by the fuel pattern setting means when the fuel pattern correcting means is not in operation.

4. A system according to claim 3 further comprising ignition timing adjusting means for advancing the ignition timing of said engine by a predetermined amount when said constant speed control means is set into operation.

5. In an internal combustion engine for a vehicle having a plurality of combustion chambers and an intake manifold, a fuel economizing system comprising in combination:

means for maintaining the speed of said vehicle substantially constant, said means including means for detecting the difference between a preset speed and the actual speed of said vehicle, and means responsive to said detecting means for varying the amount of air sucked in said intake manifold to reduce said detected difference toward zero, means for detecting at least one operating condition of said engine, means responsive to said detected operating condition for generating a fuel supply signal corresponding to the quantity of fuel required in said engine, means responsive to said fuel supply signal for feeding fuel to said engine, means for determining the change of quantity of fuel fed to said engine, and fuel supply correction means responsive to said change of quantity of fuel determining means and said speed difference detecting means for correcting said fuel supply signal corresponding to the fuel required in said engine to decrease said signal when the change of quantity of fuel fed to said engine is not increasing and the actual vehicle speed is greater than said preset speed, said fuel pattern correcting means being adapted to operate only when said constant speed control means is in operation and wherein said fuel feeding means feeds the fuel set by the fuel pattern setting means when the fuel pattern correcting means is not in operation.

6. The fuel economizing system of claim 5 wherein said means for detecting at least one operating condition of said engine includes means for detecting the intake manifold pressure varying in accordance with the amount of air sucked.

7. The fuel economizing system of claim 5 wherein said means responsive to said fuel supply signal for feeding fuel to said engine comprises at least one fuel injector, said fuel injector injecting a quantity of fuel corresponding to said fuel supply signal.

8. The fuel economizing system of claim 5 wherein said fuel correction means responsive to said change of quantity of fuel determining means and said speed difference detecting means for correcting the fuel supply signal corresponding to the fuel required in said engine incrementally decreases said signal by a predetermined increment once in each of a succession of first predetermined periods of time when the change of quantity of fuel fed to said engine is not increasing and the actual vehicle speed is greater than said preset speed and incrementally increases by a preset increment said signal once in each of a succession of second predetermined periods of time when the change of quantity of fuel fed to said engine is increasing and the actual speed of said vehicle is less than said preset speed, said first periods of time being greater than said second periods of time.

9. The fuel economizing system of claim 5 wherein said means responsive to said fuel supply signal for feeding fuel to said engine comprises at least one fuel injector, pressurized means for conveying a predetermined charge of fuel to said injector under pressure in synchronism with the rotation of the crankshaft of said engine and means responsive to said fuel supply signal for varying the quantity of charge formed in said charge forming means.

10. The fuel economizing system of claim 5 wherein said fuel supply correction means further increases said fuel supply signal corresponding to the fuel required in said engine when the change of quantity of fuel fed to said engine is increasing and the actual speed of said vehicle is less than said preset speed.

* * * * *